US007350891B2

(12) United States Patent
Oomura et al.

(10) Patent No.: US 7,350,891 B2
(45) Date of Patent: Apr. 1, 2008

(54) LIQUID DISCHARGE HEAD

(75) Inventors: Masanobu Oomura, Yokohama (JP); Fumio Murooka, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 11/113,013

(22) Filed: Apr. 25, 2005

(65) Prior Publication Data

US 2005/0237353 A1 Oct. 27, 2005

(30) Foreign Application Priority Data

Apr. 26, 2004 (JP) ..... 2004-129774

(51) Int. Cl.
*B41J 29/38* (2006.01)

(52) U.S. Cl. ..... 347/9

(58) Field of Classification Search ..... 347/9
See application file for complete search history.

(56) References Cited

U.S. PATENT DOCUMENTS

| | | | | |
|---|---|---|---|---|
| 5,767,872 | A * | 6/1998 | Scardovi et al. | 347/17 |
| 6,467,881 | B2 * | 10/2002 | Katoh | 347/55 |
| 2003/0202024 | A1 | 10/2003 | Corrigan | |
| 2004/0004647 | A1 | 1/2004 | Kawasaki et al. | |
| 2005/0052499 | A1 | 3/2005 | Oomura | |
| 2005/0275673 | A1 | 12/2005 | Oomura et al. | |

FOREIGN PATENT DOCUMENTS

| | | |
|---|---|---|
| EP | 0 749 834 A | 12/1996 |
| JP | 2001-129995 | 5/2001 |
| JP | 2001-341355 | 12/2001 |

OTHER PUBLICATIONS

Patent Abstracts of Japan, vol. 2000, No. 22, Mar. 9, 2001 (JP 2001-129995 A, May 15, 2001).

"Measurement of Temperature Gradients at the Heater of a Bubble Jet by Detection of the Nucleation," Josef Pöppel, SID International Symposium, Digest of Technical Papers, vol. XX, 1989, pp. 176-179 & 431.

* cited by examiner

*Primary Examiner*—Julian D. Huffman
(74) *Attorney, Agent, or Firm*—Fitzpatrick, Cella, Harper & Scinto

(57) ABSTRACT

The liquid discharge head has a heater resistor for heating liquid in a liquid route communicating with a discharge port and generating bubbles and a switch circuit for switching on/off the current to be supplied to the heater resistor. One end of the heater resistor is connected to a power-supply potential, one end of the switch circuit is connected to a ground potential, and the other end of the heater resistor and the other end of the switch circuit are connected to each other. The liquid discharge head has a detection circuit for detecting the voltage of the connection point between the heater resistor and the switch circuit and outputting an output signal when a predetermined change occurs in the voltage, and a switch control circuit for controlling the switching on/off of the switch circuit in accordance with the output signal.

4 Claims, 7 Drawing Sheets

FIG. 9
PRIOR ART
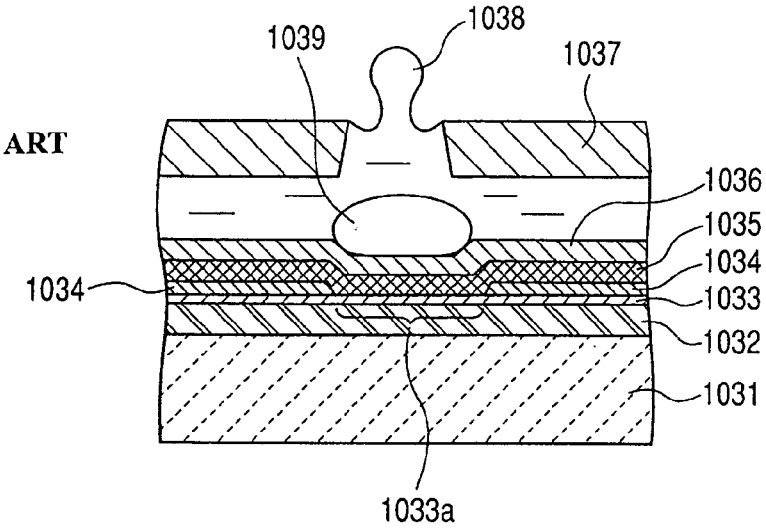
FIG. 10A
PRIOR ART
FIG. 10B
PRIOR ART
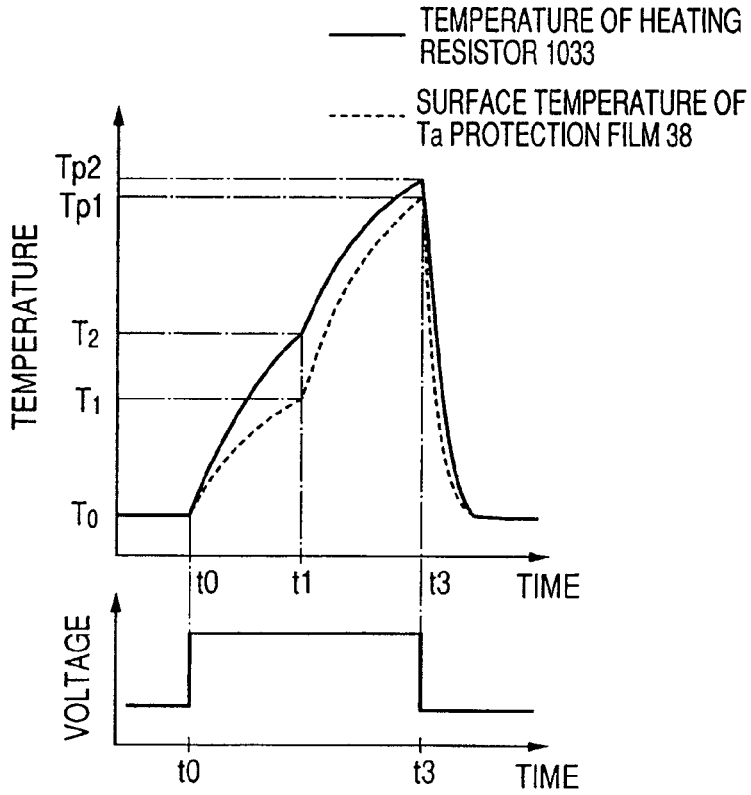

LIQUID DISCHARGE HEAD

BACKGROUND OF THE INVENTION

1. Field of the Invention

The present invention relates to a liquid discharge head having a switch circuit in a liquid discharge mechanism and a liquid discharge apparatus. Particularly, the present invention relates to an ink-jet recording head for forming an image by injecting energy into an ink discharge mechanism, discharging ink and attaching ink droplets on a recording medium and an ink-jet recorder. Moreover, the present invention relates to a liquid discharge head which can be applied to an apparatus used to fabricate a DNA chip, organic transistor or color filter and relates to a liquid discharge head for injecting energy into a liquid discharge element, discharging droplets and attaching the droplets on a medium.

2. Related Background Art

A recorder using an ink-jet recording system has been known so far as a liquid discharge apparatus. The recorder forms an image by heating ink, thereby generating bubbles to pressurize, and discharging the ink in accordance with the expansion motion of the bubbles and attaching discharged ink droplets on a recording medium. This recording system has advantages that it has a high recording quality and low noises. Moreover, the ink-jet recording system has advantages that color recording is comparatively easy, recording can be also applied to plain paper and an apparatus can be easily downsized. Furthermore, the ink-jet recording system can realize high-speed recording by arranging many discharge ports from which ink is discharged at a high density and is widely used for information output units such as a printer and facsimile.

The recording head of the ink-jet recording system generally has a discharge port for discharging ink, an ink route communicating with the discharge port and an electrothermal transducer for generating heat energy when voltage is applied. The electrothermal transducer is a thin-film heating resistor in general.

FIG. 9 is a sectional view showing a part of a conventional ink-jet recording head. A heating resistor 1033 is formed on a silicon substrate 1031. Moreover, an oxide film 1032 serving as a heat storing layer and an insulating layer is formed between the heating resistor layer 1033 and silicon substrate 1031. In the case of the heating resistor layer 1033, a region between connected electrode wirings 1034 functions as a heating resistor 1033*a*, which is heated when a pulsed voltage is applied to generate thermal energy and bubbles in ink in an ink route. When bubbles of the ink are generated, impacts are generated due to a chemical reaction of the ink or growth or disappearance of bubbles. To protect the heating resistor 1033*a* from these impacts, a tantalum (Ta) protection film 1036 is formed on the heating resistor layer 1033. An insulating protective layer 1035 made of silicon nitride (SiN) or the like is further formed under the Ta protection film 1036 in order to electrically insulate the heating resistor layer 1033 from the Ta protection film 1036.

According to the above configuration, the thermal energy generated from the heating resistor 1033*a* is transferred through the SiN insulating protection film 1035 and Ta protection film 1036 formed on the heating resistor 1033*a* in accordance with a heat conduction phenomenon. Thereby, heat is supplied to the ink on the Ta protection film 1036 and bubbles 1039 are generated in the ink. When the bubbles 1039 are generated, the ink around a nozzle 1037 serving as a discharge port of the ink is pressurized and ink droplets 1038 are discharged from the nozzle 1037.

To improve the quality of an image in recent years, the ink discharged from a discharge port tends to decrease in size. Therefore, the number of ink droplets necessary for forming the same image on one sheet is extremely increased. For example, to form an image of 15% density on a A4 sheet (210 mm×297 mm) at a density of 1,200×1,200 dots for 25.4 $mm^2$ (one square inch), the number of dots of ink of the same color becomes $1.9\times10^7$ dots/sheet. To form a color image, inks of various colors are formed on a sheet at this number of dots. Moreover, in the case of an apparatus such as a printer to which an ink-jet recording head is applied, acceleration is progressed and improvement of the number of durable recording sheets is strongly requested. To improve the number of durable recording sheets, it is necessary that ink droplets are discharged from a discharge port for a long time in the same direction at the same quantity and same speed.

However, when discharge of ink is repeated, the ink may be scorched on the surface of the Ta protection film 1036 shown in FIG. 9 and when the ink is scorched, the stability for forming bubbles is deteriorated. Moreover, when discharge of ink is repeated, the Ta protection film 1036 is shaved and becomes thin and a phenomenon that ink penetrates the Ta protection film 1036 may occur. Thereafter, infiltration of ink progresses to the insulating protection film 1035 formed on the heating resistor 1033*a*, the ink infiltrates up to the heating resistor 1033*a* and the electrode wiring 1034 connected to the heating resistor 1033*a*, galvanic corrosion progresses in the electrode wiring 1034 and finally the electrode wiring 1034 may be disconnected.

FIGS. 10A and 10B are graphs showing changes in temperature of the heating resistor 1033*a* and changes in surface temperature of the Ta protection film 1036 of a conventional ink-jet recording head. FIG. 10A is a graph showing changes in temperature of the heating resistor 1033*a* to which the thermal energy is supplied and changes in surface temperature of the Ta protection film 1036. FIG. 10B is a graph showing the waveform of a pulse voltage applied to the heating resistor 1033*a*. In FIG. 10A, the temperature of the heating resistor 1033*a* is shown by a continuous line and the surface temperature of the Ta protection film 1036 is shown by a dotted line.

The temperature of the heating resistor 1033*a* and the surface temperature of the Ta protection film 1036 become T0 same as the room temperature at the time t0 when a pulse voltage is input to the heating resistor 1033*a*. When the pulse voltage is input to the heating resistor 1033*a*, the temperature of the heating resistor 1033*a* and the surface temperature of the Ta protection film 1036 which are T0 same as the room temperature rise. At the time t1 when the surface temperature of the Ta protection film 1036 reaches T1 (=approx. 300° C.), bubbles are generated on the interface between the Ta protection film 1036 and ink. In this case, the temperature of the heating resistor 1033*a* already reaches T2. Because bubbles are generated, heat is not propagated from the surface of the Ta protection film 1036 to the ink. Therefore, the surface temperature of the Ta protection film 1036 starts a sudden rise. Similarly, the temperature of the heating resistor 1033*a* also suddenly rises. These temperatures show the vertex at the time t3 when application of the pulse voltage to the heating resistor 1033*a* is stopped and values of the temperatures becomes TP1 and TP2 respectively. After the time t3 when application of the pulse voltage to the heating resistor 1033*a* is stopped, thermal energy is not generated from the heating resistor 1033*a*.

Therefore, the temperature of the heating resistor 1033*a* and the surface temperature of the Ta protection film 1036 suddenly lower and return to the original room temperature T0. It is experimentally clarified that the durability of the ink-jet recording head is extremely improved by decreasing the interval between the time t3 when application of the pulse voltage input to the heating resistor 1033*a* is stopped and the time t1 when bubbles are generated and lowering the highest reaching temperature TP1 of the heating resistor 1033*a* and the highest reaching temperature TP2 of the Ta protection film 1036.

To lower the highest reaching temperature TP1 of the heating resistor 1033*a* and the highest reaching temperature TP2 of the Ta protection film 1036, various devices are made. It is an example to set a temperature sensor to an ink-jet recorder, sense the temperature of in ink-jet recording head by the temperature sensor and set a controller for modulating the width of a pulse voltage for driving a heating resistor to the printer body. However, the temperature sensor is used to measure the temperature of the whole ink-jet recording head but it is not used to accurately measure the temperature near the heating resistor. Moreover, Japanese Patent Application Laid-Open No. 2001-341355 (Patent Document 1) discloses an example of setting a controller for controlling the time for driving a plurality of heating resistors to the body of a printer when the heating resistors are simultaneously driven and the number of heating resistors to be driven is sequentially changed in accordance with the number of heating resistors to be simultaneously driven.

As means for solving the problem of the above conventional ink-jet recording head, there is the configuration disclosed in Japanese Patent Application Laid-Open No. 2001-129995 (Patent Document 2). FIG. 11 shows a configuration in which a semiconductor diffusion resistor 1040 formed by diffusing impurities immediately below the heating resistor 1033*a* having the structure shown by a sectional view of a conventional ink-jet recording head (FIG. 4) is arranged. Moreover, FIG. 12 shows a circuit block diagram of an ink-jet recording head using the structure in FIG. 11.

FIG. 12 is an equivalent circuit diagram of the control portion of the ink-jet recording head shown in FIG. 11. The equivalent circuit of the control portion of the ink-jet recording head is constituted of the heating resistor 1033*a*, a power supply 1011 for supplying power to the heating resistor 1033*a*, a switch 1013 to be turned on when a switch driving signal 1017 is input, a sensor 1014 for outputting a control signal 1016 when detecting occurrence of bubbles and a driving control circuit 1018 for inputting an image input signal 1015 and the control signal 1016 and outputting a switch driving signal 1017. The sensor 1014 detects occurrence of bubbles by using a change of resistance values of the semiconductor diffusion resistor 1040. It is possible to accurately estimate a temperature difference from the surface temperature of the Ta protection film 1036 in accordance with thicknesses, thermal conductivities or densities of the insulating protection film 1035 and Ta protection film 1036. Therefore, the sensor 1014 can detect occurrence of bubbles by determining the surface temperature of the Ta protection film 1036 from the electric resistance value of the semiconductor diffusion resistor 1040.

When the image input signal 1015 is not input, the driving control portion 1018 does not output the switch driving signal 1017 and the switch 1013 is kept turned-off. When the image input signal 1015 is input to the driving control portion 1018 but the control signal 1016 is not input to it, the driving control portion 1018 outputs the switch driving signal 1017. Then, the switch 1013 is turned on and the heating resistor 1033*a* produces heat. However, even if the image input signal 1015 is input to the driving control portion 1018, when occurrence of bubbles is detected by the sensor 1014 and the control signal 1016 is input to the driving control portion 1018, the driving control portion 1018 does not output the switch driving signal 1017 but the switch 1013 is turned off.

According to the above configuration, it is detected that bubbles on ink are generated from a change of resistance values of the semiconductor diffusion resistor 1040 caused by heat generation of the heating resistor 1033*a*. Moreover, it is proposed to stop voltage application to the heating resistor in accordance with the detection result, restrain extra heat generation of the heating resistor 1033*a* and improve the durability of an ink-jet recording head.

Moreover, Japanese Patent Application Laid-Open No. H07-068907 discloses a configuration provided with detection means for detecting a voltage applied to a piezoelectric element and blocking means for blocking switching means in accordance with a detection result by the detection means in order to prevent an ink-jet recording head for detecting a short circuit of a piezoelectric element to control a power supply switch from being damaged due to a short circuit.

However, the conventional ink-jet recording head shown in FIG. 9 detects the general temperature of the ink-jet recording head as a representative value but it does not detect the temperature of each heating resistor.

Therefore, the pulse width of a pulse voltage to be applied to a heating resistor for actual driving is not set for every individual heating resistor by considering the fluctuation of the total resistance value of a heating resistor, power-supply wiring resistance and switch circuit but it is set to the maximum pulse width necessary for ink to be expanded and discharged in a certain ink-jet recording head. In other words, a pulse voltage more than necessity is applied to a certain heating resistor to cause the durability and stability of a recording head to deteriorate. Therefore, combination of power-supply wiring resistances is used as one of correction means for decreasing the fluctuation of the total resistance value of a heating resistor, power-supply wiring resistance and switch circuit in an ink-jet recording head. Detection and setting of the maximum pulse width necessary for ink to be expanded and discharged is performed when the ink is shipped from a factory and its result is recorded in and set to a nonvolatile memory (EEROM) set in a recording head. Therefore, only by preparing the comparatively expensive nonvolatile memory, the cost of the printer body increases.

Moreover, in the case of the configuration (refer to FIGS. 11 and 12) disclosed in Patent Document 2, the heat generated by each heating resistor is detected, its detection result is fed back to a driving control portion and a pulse width is controlled for each heating resistor. Therefore, unnecessary voltage application time disappears and it is possible to improve the durability of a heating resistor and the durability of a recording head in its turn. However, because it is necessary to embed a semiconductor diffusion resistor immediately under a heating resistor, the configuration of a heating resistor region becomes complex and a physical step more than necessity is formed around a heating resistor. Therefore, the configuration and function of a nozzle portion may be greatly affected.

The present invention is made to solve the above problems and its object is to provide a liquid discharge head capable of improving the durability and stability of a liquid discharge mechanism (heating resistor) and a liquid discharge head in its turn without making the shape of the region of the liquid discharge mechanism complex.

SUMMARY OF THE INVENTION

To achieve the above object, a liquid discharge head of the present invention uses a liquid discharge head in which a liquid discharge mechanism and a switch circuit are electrically connected in series between a first power supply and a second power supply to perform discharge control of liquid by controlling energy injection to the liquid discharge mechanism by the switch circuit, in which a detection circuit is included which detects the voltage at the connection point between the liquid discharge mechanism and the switch circuit and outputs an output signal when a predetermined change occurs in the voltage at the connection point.

BRIEF DESCRIPTION OF THE DRAWINGS

FIG. 9 is a sectional view showing a part of a conventional ink-jet recording head;

FIG. 10A is a graph showing changes in temperature of the heating resistor and changes in surface temperature of the Ta protection film of a conventional ink-jet recording head;

FIG. 10B is a graph showing the waveform of a pulse voltage applied to the heating resistor;

DESCRIPTION OF THE PREFERRED EMBODIMENTS

Because a liquid discharge head of the present invention has a detection circuit for detecting the voltage at the connection point between a liquid discharge mechanism and a switch circuit and outputting an output signal when a change occurs in the voltage at the connection point, it is possible to improve the durability and stability of the liquid discharge mechanism and the liquid discharge head in its turn without making the shape of the region of the liquid discharge mechanism complex.

Moreover, it is possible to control on/off of the switch circuit in accordance with a voltage change at the connection point caused by the fact that the resistance of a heating resistor changes after liquid generates bubbles. Therefore, it is possible to prevent that voltage pulses are extremely applied to the liquid discharge mechanism after liquid generate bubbles and it is possible to improve the durability of the liquid discharge mechanism and the durability of the liquid discharge head in its turn.

Furthermore, as another advantage, it is possible to prevent scorch (some of liquid components scorch on the liquid discharge mechanism because it is heated) from occurring on the liquid discharge mechanism and stably perform liquid discharge from the liquid discharge head.

Furthermore, as still another advantage, it is possible to improve the durability of the liquid discharge mechanism without making the configuration of the region of the liquid discharge mechanism complex because it is not necessary to set a semiconductor diffusion resistor under the liquid discharge mechanism of the liquid discharge head.

Furthermore, in the case of a liquid discharge head provided with many liquid discharge mechanisms, it is not necessary to perform the correction for restraining the fluctuation of the total resistance value of a liquid discharge mechanism between individual power supply potential and ground potential, switch circuit and power-supply wiring circuit. Therefore, it is not necessary to detect and set the maximum pulse width necessary for liquid to be discharged and moreover, a nonvolatile memory for recording setting of a pulse width is unnecessary.

Furthermore, a conventional apparatus is provided with a PWM circuit in order to change voltage pulse widths in accordance with a voltage pulse width different for each individual liquid discharge head. However, a liquid discharge head provided with a configuration of the present invention can make voltage pulse widths common. Therefore, it is unnecessary to use the PWM circuit. Therefore, it is possible to decrease the fabrication cost of not only a liquid discharge head but also the body of an apparatus using it.

Embodiments of the present invention are described below by referring to the accompanying drawings.

First Embodiment

Figure 1:
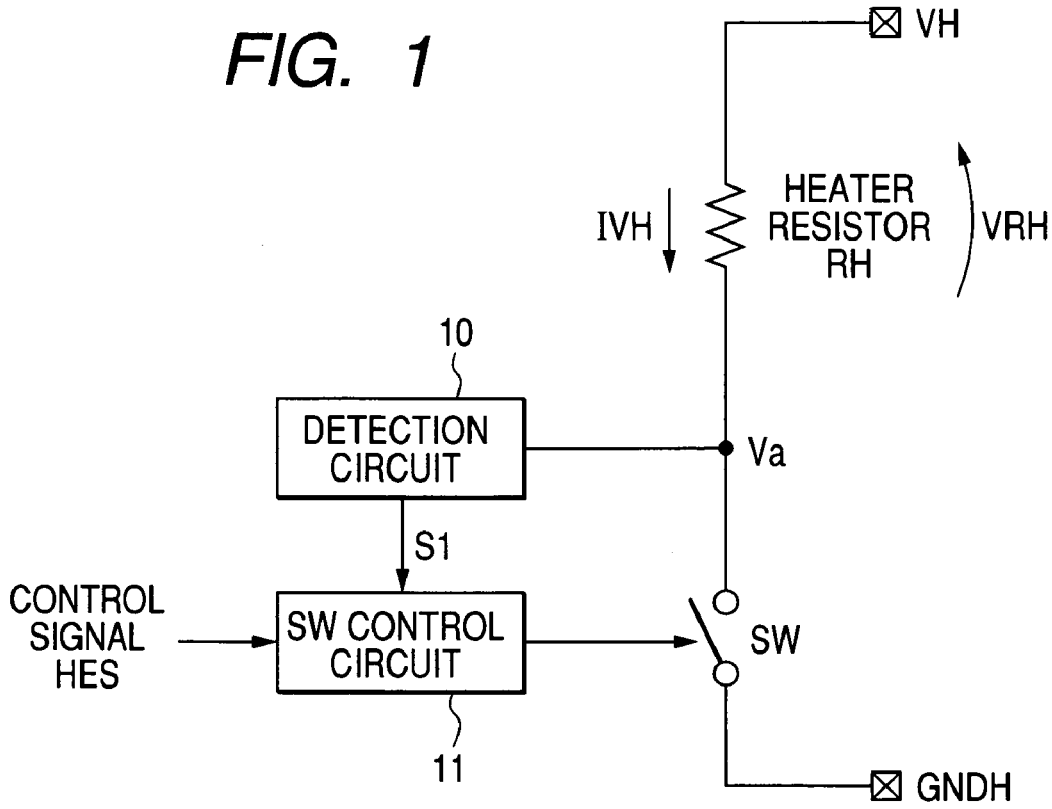
FIG. 1 is an equivalent circuit diagram of the control portion of a liquid discharge head of first embodiment of the present invention.

FIG. 1 is an equivalent circuit diagram of the control portion of a liquid discharge head of first embodiment of the present invention.

Figure 11:
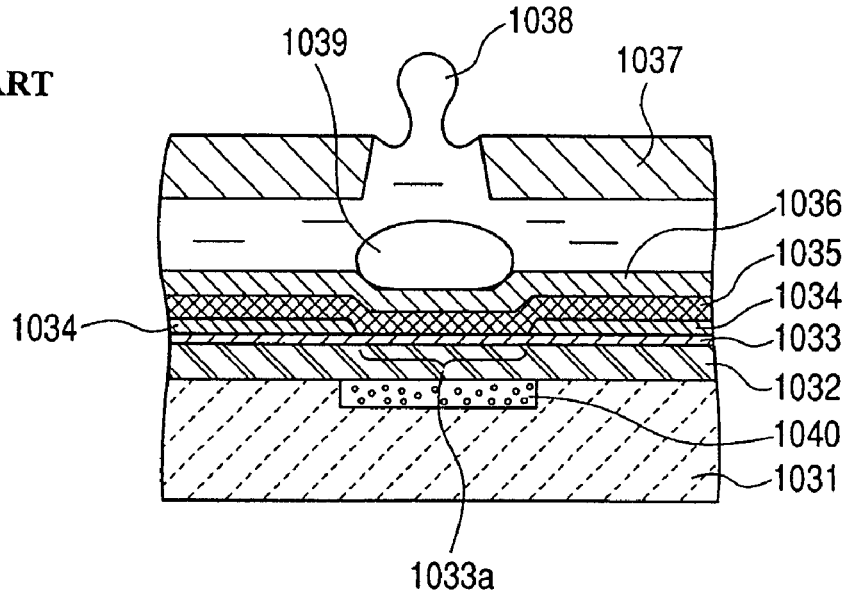
FIG. 11 PRIOR ART
FIG. 11 is a sectional view showing a part of a conventional ink-jet recording head.
Figure 12:
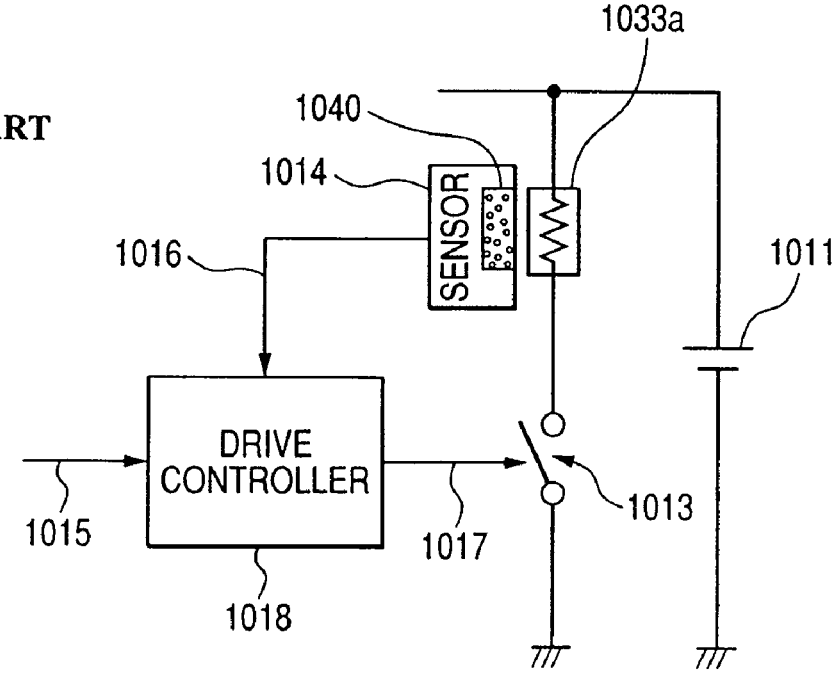
FIG. 12 PRIOR ART
FIG. 12 shows a equivalent circuit diagram of an ink-jet recording head using the structure in FIG. 11.

In the case of the control portion of the liquid discharge head of this embodiment, a heating resistor (hereafter referred to as heater resistance RH) serving as a liquid discharge mechanism and a switch circuit SW are connected in series between power-supply potential VH and ground potential GNDH and a detection circuit 10 for detecting the voltage Va of a connection point between the heater resistance RH and the switch circuit SW is connected to the connection point. An output signal of a switch control circuit (SW control circuit) 11 is input to the control terminal of the switch circuit SW and the switch circuit SW is controlled and the current flowing through the heater resistance RH is controlled. A control signal HES corresponding to (having correlation with) an image signal and output signal S1 from the detection circuit 10 are input to the switch control circuit 11. In this case, the heater resistance RH is formed of, for example, tantalum silicon nitride and has a negative temperature coefficient. The control portion thus constituted can be applied to an ink-jet recording head having a configuration of the prior art shown in FIG. 9, that is, an ink-jet recording head not having a semiconductor diffusion resistor shown in FIG. 11 below a heating resistor (heater resistance) serving as a liquid discharge element.

Then, operations of the control portion of the liquid discharge head (ink-jet recording head) of this embodiment are described below.

First, an ink discharge instruction is transmitted to a recording head from the body of a printer to which a recording head provided with the control portion shown in FIG. 1 is mounted as a control signal HES. Then, the switch control circuit 11 turns on the switch circuit SW and applies a voltage to the both ends of the heater resistance RH to start flowing a current IVH to the heater resistance RH. When the current flows to the heater resistance RH, the voltage Va at the connection point between the heater resistance RH and the switch circuit SW becomes a voltage lowered by a potential difference VRH obtained by subtracting a voltage applied to the heater resistance RH from the power-supply potential VH. Moreover, as previously described, the heater resistance RH generates heat when a current flows to the heater resistance RH and starts heating the ink in an ink route through an insulating protection film and the Ta protection film.

When the surface temperature of the Ta protection film becomes approx. 300° C. due to heat generation of the heater resistance RH, the ink on the heater resistance RH starts generating bubbles. When the ink on the heater resistance RH is expanded, a medium for absorbing the heat discharged from the heater resistance RH is deteriorated. Therefore, the temperature of the heater resistance RH itself suddenly rises. This is described for Description of Prior Art.

As described above, in the case of this embodiment, the heater resistance RH has a negative temperature coefficient. Therefore, when the temperature of the heater resistance RH itself suddenly rises, the resistance value of the heater resistance RH suddenly decreases and the voltage Va at the connection point suddenly rises. Therefore, by detecting a voltage change of the voltage Va by the detection circuit 10 (for example, by detecting whether the voltage Va exceeds a predetermined voltage), it is possible to detect presence or absence of expansion of the ink on the heater resistance RH. Moreover, when the detection circuit 10 detects that the ink is expanded, it outputs an output signal S1 correlating to the fact that the ink is expanded to the switch control circuit 11 and the switch control circuit 11 which has received the output signal S1 controls the switch circuit SW to off-state. In this case, the correlation is a signal obtained by previously setting a threshold value even except a state in which ink is completely discharged and regarding a case in which the remaining quantity of the ink becomes a certain quantity or less as a case in which discharge is completed.

Thereby, it is possible to decrease the time in which voltage pulses are extremely applied to the heater resistance RH after ink is expanded and improve the durability of a recording head. Moreover, it is possible to decrease the rate in which scorch (some of ink components scorch on heater resistance RH because they are heated) occurs on the heater resistance RH and stably discharge ink.

As described above, the phenomenon that the voltage Va at the connection point suddenly rises when the temperature of the heater resistance RH itself suddenly rises and the resistance value of the heater resistance RH suddenly decreases can be described in accordance with the following expression (1).

$$Va=\{r/(\mathrm{RH}+r)\}\times VH \quad (1)$$

In this case, r denotes the total resistance value included in a power-supply wiring circuit between the above connection point and the ground potential GNDH and the switch circuit SW. From the expression (1), it is found that when the resistance value of the heater resistance RH decreases, the denominator component (RH+r) decreases and the voltage Va rises.

According to a configuration of this embodiment, it is possible to improve the durability of the heater resistance of a recording head without making the configuration of the region of the heater resistance complex because it is unnecessary to set a semiconductor diffusion resistor below the heater resistance. Moreover, according to the configuration of this embodiment, in the case of an ink-jet recording head provided with many heater resistances, it is unnecessary to perform the correction for restraining the fluctuation of the total resistance value of the heater resistance RH between individual power-supply potential VH and the ground potential GNDH, switch circuit SW and power-supply wiring circuit. Furthermore, it is unnecessary to detect and set the maximum pulse width necessary for ink to be discharged and a nonvolatile memory for recording setting of a pulse width is unnecessary. The body of a conventional printer using the recording head is provided with a PWM circuit in order to change voltage pulse widths in accordance with a voltage pulse width different for each recording head. However, in the case of a recording head provided with the configuration of this embodiment, it is possible to make voltage pulse widths common. Therefore, it is unnecessary to set the PWM circuit to the body of a printer using a recording head provided with the configuration of this embodiment. Therefore, according to the configuration of this embodiment, it is possible to decrease the fabrication cost of not only a liquid discharge head but also the body of an apparatus using the head.

The configuration of this embodiment can be applied to detection of non-discharge of ink. In this case, three causes are roughly considered for non-discharge of ink.

Cause 1: Because an ink incoming route is clogged with dirt and ink is not charged on the heater resistance RH, the ink is not discharged.

Cause 2: Because the heater resistance RH does not function as a heating resistor due to expiry of lifetime (in the case of disconnection) ink is not discharged.

Cause 3: Because the discharge port of ink is clogged with dirt, the ink is not discharged.

In the case of the configuration of this embodiment, it is possible to detect non-discharge of ink for causes 1 and 2 among the above three causes.

In the case of the cause 1, because ink is not injected onto the heater resistance RH, a state same as an ink expanded state is realized and sudden rise of the voltage Va at the connection point almost simultaneously occurs as input of the control signal HES. Therefore, by detecting whether the voltage Va is changed in the time earlier than a predetermined time elapses after applying the voltage to the heater resistance RH (whether the voltage Va exceeds the predetermined time), it is possible to detect non-discharge of ink.

In the case of the cause 2, even if applying a voltage to the heater resistance RH, a sudden voltage change in the voltage Va at the connection point does not occur. Therefore, by detecting whether the voltage Va is changed when a predetermined time elapses after applying a voltage to the heater resistance RH (for example, whether the voltage Va exceeds a predetermined voltage), it is possible to detect non-discharge of ink. In the case of detection of non-discharge of ink, it is considered to feedback-control a detection signal to the original state but in this case, not control of only a heater board but control including a system is realized.

Thus, according to the configuration of this embodiment, it is possible to prevent overheat of the heater resistance RH by the detection circuit 10 serving as means for detecting a change in the voltage Va at the connection point between the heater resistance RH and the switch circuit SW and the switch control circuit 11 for controlling on/off the switch circuit SW in accordance with presence or absence of detection of the change in the voltage Va. When the detection circuit 10 detects whether the voltage Va is changed in accordance with whether the voltage Va exceeds a predetermined voltage, it is not always necessary that the switch control circuit 11 has a complex configuration for controlling the switch circuit SW in accordance with the value of the voltage Va.

Though this embodiment is described by assuming the temperature coefficient of a heater resistance as being negative, it is possible to easily analogize that it is possible to theoretically detect the expanded sate of ink in accordance with even a positive temperature coefficient.

Second Embodiment

Figure 2:
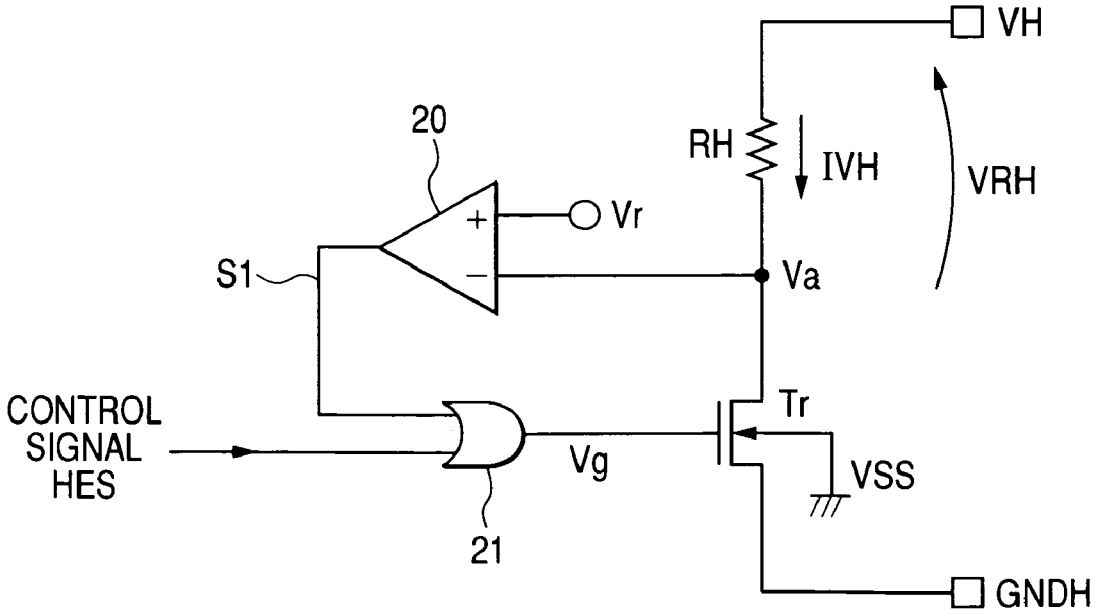
FIG. 2 is an equivalent circuit diagram of the control portion of a liquid discharge head of second embodiment of the present invention.

FIG. 2 is an equivalent circuit of the control portion of a liquid discharge head of second embodiment of the present invention.

In the case of the control portion of the liquid discharge head of this embodiment, a heater resistance RH and an N-type MOS transistor Tr constituting a switch circuit is electrically arranged in series between a power supply potential VH and a first ground potential GNDH. Moreover, the voltage Va at the connection point (drain end of the transistor Tr) of the heater resist and RH and the transistor Tr is input to the negative input terminal of a comparator circuit 20. Moreover, a reference voltage Vr is input to the positive input terminal of the comparator circuit 20. In this case, the reference voltage Vr is a voltage to be applied to the heater resistance RH when the heater resistance RH starts expanding ink.

An output signal S1 (first output signal) of the comparator circuit 20 and a control signal HES (first signal) corresponding to an image signal (having correlation) are input to an OR circuit 21. An output Vg (second output signal) of the OR circuit 21 is input to the gate of the transistor Tr. The source of the transistor Tr is connected to a first ground potential GNDH and the substrate potential (back gate) of the transistor Tr is connected to a second ground potential VSS. In this case, it is allowed that the second ground potential VSS is equal to the first ground potential GNDH. That is, it is allowed that the source and back gate of the transistor Tr are short-circuited.

The heater resistance RH of this embodiment also has a negative temperature coefficient the same as the first embodiment does. Moreover, the control portion thus constituted can be applied to the ink-jet recording head of prior art shown in FIG. 9, that is, an ink-jet recording head provided with a configuration not having a semiconductor diffusion resistor shown in FIG. 11 under a heating resistor (heater resistance).

In the case of the configuration shown in FIG. 2, an N-type MOS transistor is used for the transistor Tr serving as a switch circuit. However, a transistor applicable to this embodiment is not restricted to the above transistor. Any transistor or switch circuit using the transistor can be used as long as the transistor or switch circuit can turn on/off the current flowing through the heater resistance RH by an output of the OR circuit 21. For example, it is possible to use one of an NPN bipolar transistor, MOS transistor, offset MOS transistor in which the source and drain are arranged by setting offset with the gate, LDMOS (Lateral Double-diffused Metal Oxide Semiconductor) transistor and VDMOS transistor as an N-type transistor. Among them, the LDMOS transistor has an easy process and makes it possible to easily achieve a high withstand voltage. Therefore, the LDMOS transistor is preferable when applying it to the liquid discharge head.

Figure 3:
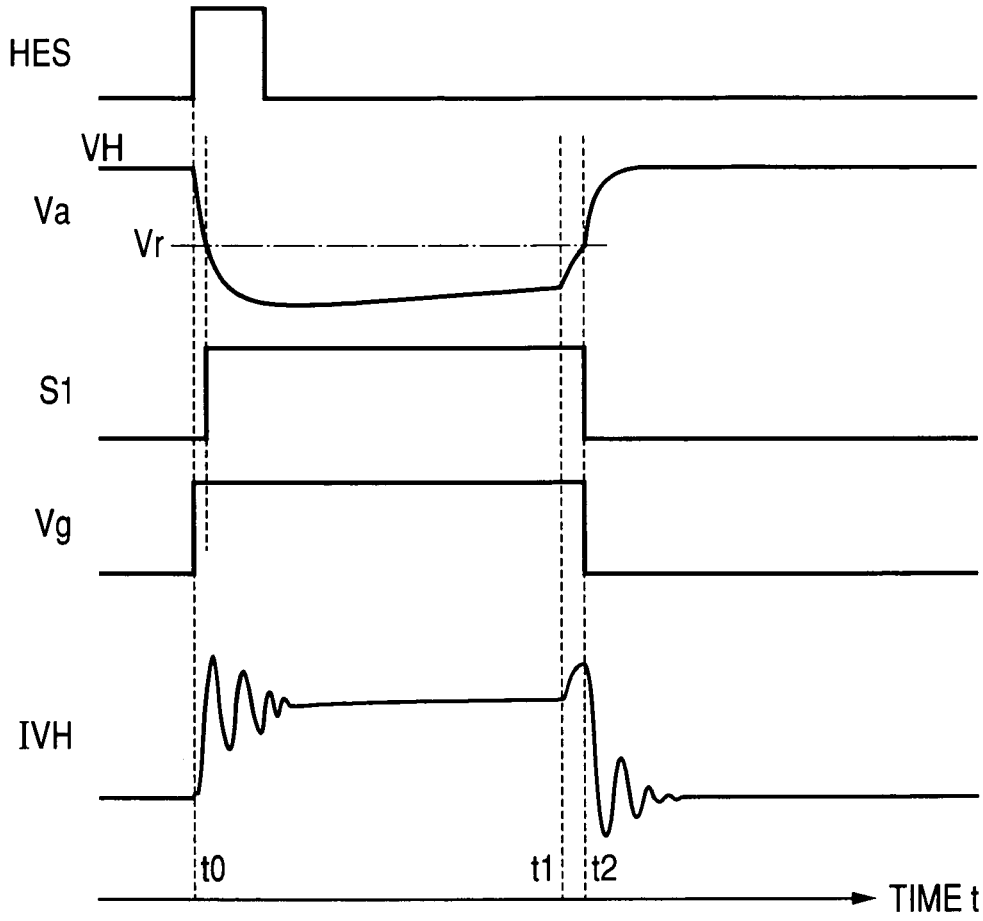
FIG. 3 is an illustration of graphs showing voltage change and current change at operating a liquid discharge head having the configuration shown in FIG. 2.

Then, operations of the control portion of the liquid discharge head of this embodiment are described. FIG. 3 is an illustration of graphs showing voltage change and current change when operating a liquid discharge head having the configuration of this embodiment.

As shown in FIG. 3, because the output signal S1 of the comparator circuit 20 is kept at low level at the time t0, an ink discharge instruction is transmitted in accordance with image data to a recording head provided with the control portion shown in FIG. 2 as the control signal HES from the body of a printer to which the recording head is set. When the signal HES changes from low level to high level, the output Vg of the OR circuit 21 also changes from low level to high level. Thereby, the transistor Tr is controlled to be turned on, a voltage is applied to the heater resistance RH and the current IVH flows.

When the current IH flows through the heater resistance RH, the heater resistance RH generates heat and starts heating ink through an insulating protection film and a Ta protection film and the voltage Va of the drain end of the transistor Tr changes from the power supply potential VH to a voltage lowered by the potential difference VRH generated across the heater resistance in accordance with a time constant $\tau$.

Immediately after the heater current IVH starts flowing, the comparator circuit 20 outputs the low-level output signal S1 because the voltage Va at the drain end of the transistor Tr is higher than the reference voltage Vr and when the voltage Va changes in accordance with the time constant $\tau$and becomes a voltage lower than the reference voltage Vr, the comparator 20 outputs the high-level output signal S1. Then, after predetermined time elapses, the control signal HES, preferably after the time two times or more larger than the average time constant $\tau$ of a normally-operated recording head elapses and the output signal S1 of the comparator circuit 20 changes to high level, the signal changes to low level.

Because the heater resistance RH has a negative temperature coefficient, when it starts heating ink and the temperature of the heater resistance RH rises, the resistance value of the heater resistance RH slowly decreases. However, when the surface temperature of the Ta protection film becomes approx. 300° C. and the ink on the heater resistance RH starts expanding (the time t1 in FIG. 3), a medium for absorbing the heat generated by the heater resistance RH disappears. Therefore, the temperature of the heater resistance RH itself suddenly rises, the resistance value of the heater resistance RH also suddenly decreases and the voltage Va of the drain end of the transistor Tr suddenly rises. This phenomenon can be explained by the above expression (1) when assuming the total resistance value included in the power-supply wiring circuit and switch circuit (including the transistor Tr) between the above connection point and the ground potential GNDH as r.

When the voltage Va of the drain end of the transistor Tr becomes a voltage higher than the reference voltage Vr, the comparator circuit 20 outputs the low-level output signal S1

(the time t2 in FIG. 3), thereby the output signal Vg of the OR circuit 21 also becomes low level and the transistor Tr is turned off. Because the maximum current value of heater current IVH is decided by a saturated region characteristic according to a voltage applied to the gate of the transistor Tr, the heater current IVH is automatically restricted.

Thereby, it is possible to prevent voltage pulses from being excessively applied to the heater resistance RH after ink is expanded and improve the durability of a recording head. Moreover, it is possible to prevent scorch (some of ink components scorch on the heater resistance RH when they are heated) from being formed on the heater resistance RH and stably perform ink discharge.

Moreover, according to the configuration of this embodiment, it is unnecessary to set a semiconductor diffusion resistor under the heater resistance of a recording head. Therefore, it is possible to improve the durability of the heater resistance without making the configuration of the region of the heater resistance complex. Furthermore, according to the configuration of this embodiment, in the case of an ink-jet recording head provided with many heater resistances, it is unnecessary to perform the correction for restraining the fluctuation of the total resistance value of a heater resistance RH, switch circuit (including transistor Tr) and power-supply wiring circuit between each power-supply potential VH and ground potential GNDH and detect and set the maximum pulse width necessary for ink to be discharged and moreover a nonvolatile memory for recording setting of the pulse width is unnecessary. The body of a conventional printer using such a recording head is provided with a PWM circuit in order to change voltage pulse widths in accordance with a voltage pulse width different for each recording head. However, in the case of the recording head having the configuration of this embodiment, because a voltage pulse width is common, it is unnecessary to set the PWM circuit to the body of a printer using the recording head provided with the configuration of this embodiment.

Moreover, the configuration of this embodiment can be applied whenever detecting non-discharge of ink similarly to the case of the first embodiment.

Third Embodiment

Figure 4:
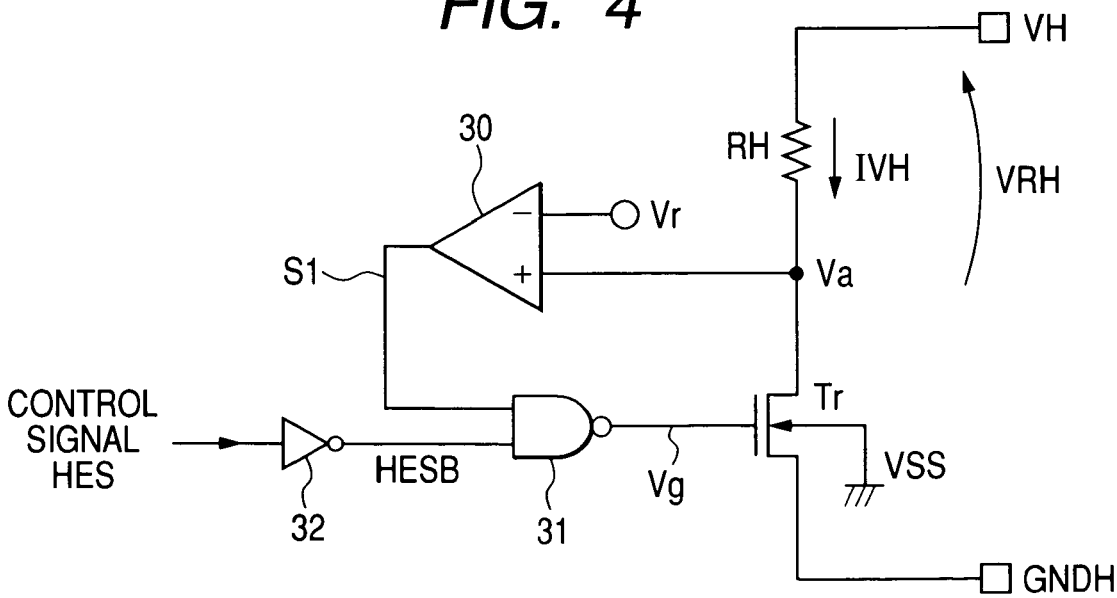
FIG. 4 is an equivalent circuit diagram of the control portion of a liquid discharge head of third embodiment of the present invention.

FIG. 4 is an equivalent circuit diagram of the control portion of a liquid discharge head of third embodiment of the present invention.

Because the basic configuration of this embodiment is the same as that of the above-describe second embodiment, different points from the second embodiment are mainly described below.

In the case of the control portion of the liquid discharge head of this embodiment, the voltage Va of the drain end of the transistor Tr is input to the positive input terminal of a comparator circuit 30 and the reference voltage Vr which is a voltage applied to the heater resistance RH when the heater resistance RH starts expanding ink is input to the negative input terminal of the comparator circuit 30. The control signal HES is input to an inverter circuit 32 and an output signal HESB (first signal) of the inverter 32 and the output signal S1 (first output signal) of the comparator circuit 30 are input to a NAND circuit 31. The output signal Vg (second output signal) of the NAND circuit 31 is input to the gate of the transistor Tr.

Figure 5:
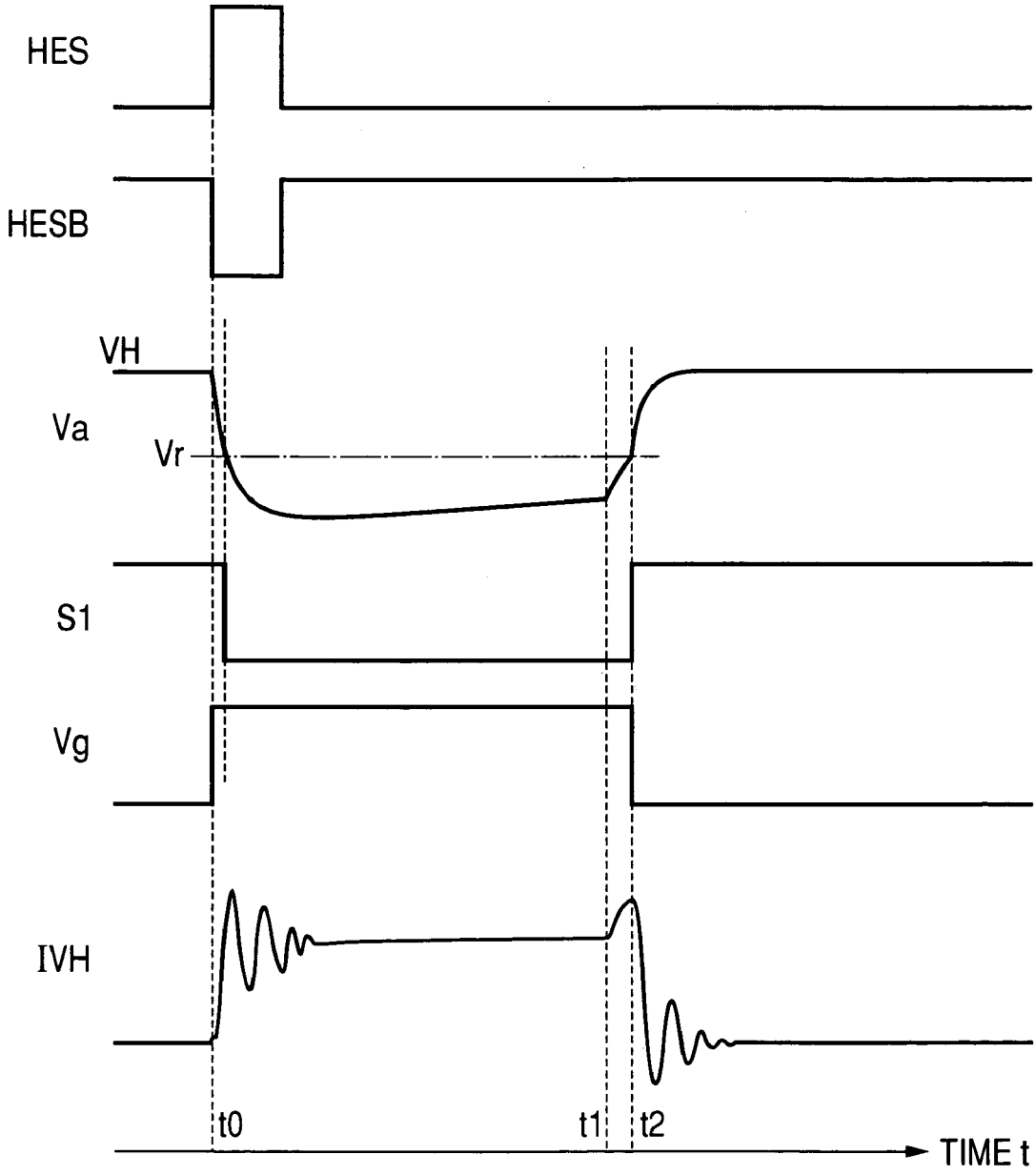
FIG. 5 is an illustration of graphs showing voltage change and current change at operating a liquid discharge head having the configuration shown in FIG. 4.

Then, operations of the control portion of the liquid discharge head of this embodiment are described below. FIG. 5 is an illustration of graphs showing voltage change and current change of each point when operating the liquid discharge head of the configuration of this embodiment.

As shown in FIG. 5, because the output signal S1 of the comparator circuit 20 is kept at high level up to the time t0, when the high-level control signal HES is input to the inverter circuit 32, the low-level signal HESB is input to the NAND circuit 31 from the inverter circuit 32 and the output signal Vg of the NAND circuit 31 becomes high level and the transistor Tr is turned on.

When the transistor Tr is turned on, the current IVH flows through the heater resistance RH and the voltage Va of the drain end of the transistor Tr starts lowering from the power supply potential VH by the potential difference VRH generated at the both ends of the heater resistance RH. When the voltage Va becomes lower than the reference voltage Vr, the comparator circuit 30 outputs the low-level output signal S1.

Immediately after the heater current IVH starts flowing, the comparator circuit 30 outputs the high-level output signal S1 because the voltage Va of the drain end of the transistor Tr is higher than the reference voltage Vr. When the voltage Va changes in accordance with the time constant sand becomes a voltage lower than the reference voltage Vr, the comparator circuit 30 outputs the low-level output signal S1. Moreover, the control signal HES changes to low level after predetermined time elapses, preferably the time two times or more larger than the average time constant $\tau$ of a normally-operated recording head elapses and the output signal S1 of the comparator circuit 30 changes to low level.

When current flows through the heater resistance RH, the heater resistance RH generates heat and ink is heated and starts expanding (time t1 in FIG. 5), the temperature of the heater resistance RH suddenly rises because a medium for absorbing the heat generated by the heater resistance RH disappears. According to this, the resistance value of the heater resistance RH suddenly decreases and the voltage Va of the drain end of the transistor Tr suddenly rises. Then, when the voltage Va becomes higher than the reference voltage Vr, the comparator circuit 30 outputs the high-level output signal S1 (time t2 in FIG. 5) and the NAND circuit 31 as a switch control circuit outputs the low-level output signal Vg in order to turn off the transistor Tr.

Thereby, it is possible to prevent voltage pulses from being excessively applied to the heater resistance RH after ink expands and improve the durability of a recording head. Moreover, because it is unnecessary to set a semiconductor diffusion resistor under the heater resistance of the recording head, it is possible to improve the durability of the heater resistance without making the configuration of the region of the heater resistance complex.

Other advantage of the configuration of this embodiment is the same as that of the above second embodiment.

Other Embodiment

<Liquid Discharge Apparatus)

A liquid discharge head of an embodiment of the present invention forms a heating resistor by a heating resistance layer formed on the insulating layer of a semiconductor device according to each of the above embodiments and forms a discharge port and a liquid route communicating with the discharge port. Therefore, the head can be fabricated by combining discharge-port forming members such as top boards constituted of a molding resin and a film. Moreover, by connecting a liquid vessel to the liquid discharge head, mounting them on the body of a liquid discharge apparatus and supplying a power supply potential from the power supply circuit of the apparatus body and image data from the image processing circuit of the apparatus body to the liquid discharge apparatus, the apparatus body and the liquid discharge head mounted on the apparatus body operate as an ink-jet printer.

Figure 6:
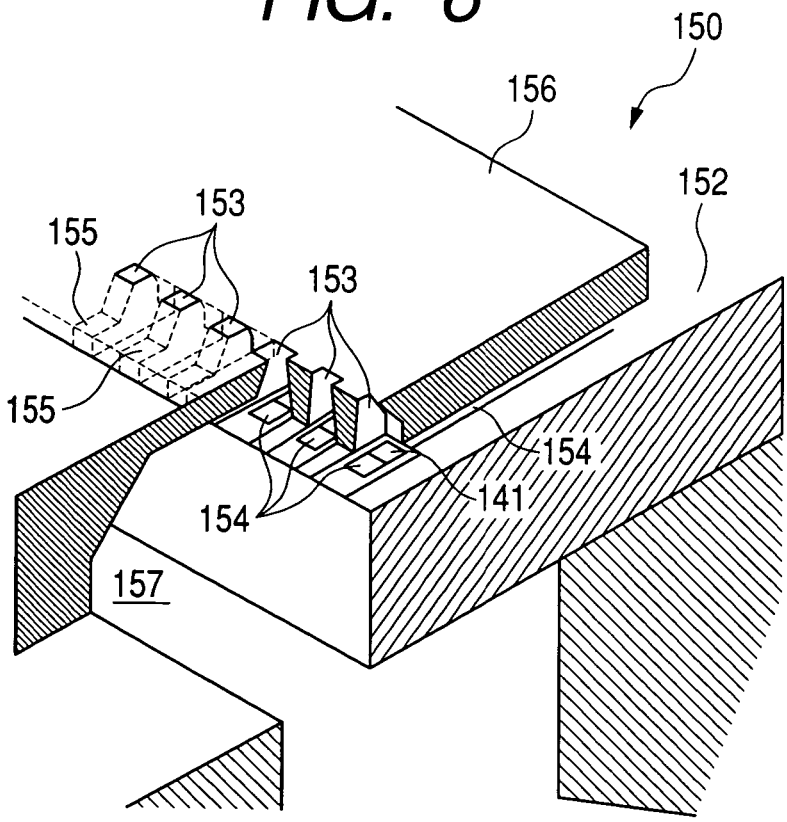
FIG. 6 is an illustration for explaining the discharge unit of the liquid discharge head of an embodiment of the present invention.

FIG. 6 is an illustration for explaining the discharge unit of the liquid discharge head of an embodiment of the present invention, which shows a state of breaking a part of the unit.

A plurality of electrothermal transducers 141 for generating heat by receiving an electrical signal for current to flow and discharging ink from a discharge port 153 in accordance with bubbles generated by the heat are arranged in rows on an element substratum 152 on which the circuit of a control portion described for each of the above embodiments is formed. A wiring electrode 154 for supplying an electrical signal for driving each electrothermal transducer 141 is set to each of the electrothermal transducers 141 and one end of the wiring electrode 154 is electrically connected to the above described switch circuit (switch SW or transistor Tr).

Channels 155 for supplying ink to the discharge port 153 set to a position facing the electrothermal transducer 141 are formed correspondingly to each discharge port 153. Walls constituting these discharge ports 153 and the channel 155 are set to groove-provided members 156. By connecting these groove-provided members 156 to the above element substratum 152, the channels 155 and a common liquid chamber 157 for supplying ink to these channels 155 are formed.

Figure 7:
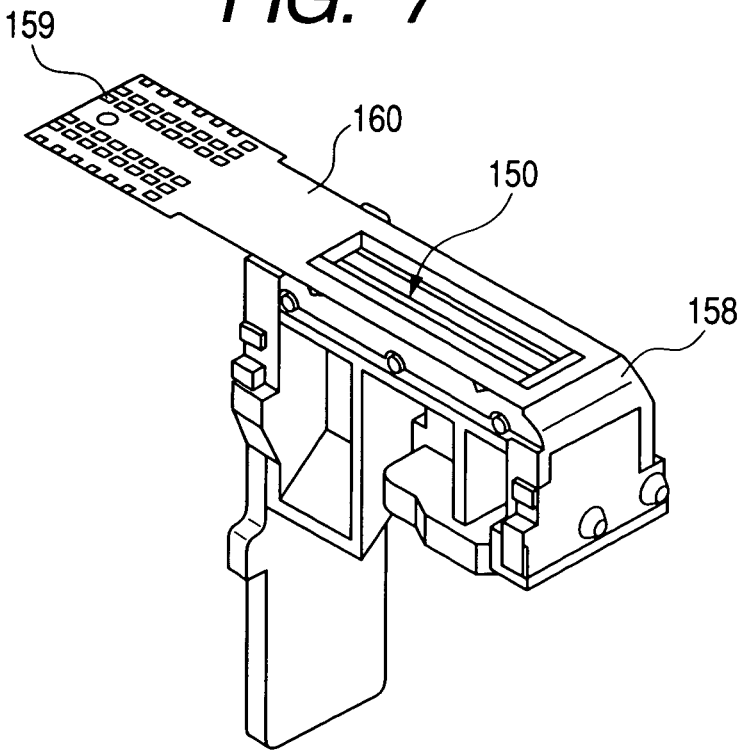
FIG. 7 is a perspective view showing a structure of a liquid discharge head in which the discharge unit shown in FIG. 6 is built.

FIG. 7 is a perspective view showing a structure of a liquid discharge head in which the discharge unit shown in FIG. 6 is built.

As shown in FIG. 7, a discharge unit 150 is built in a frame 158. As described above, the discharge unit 150 is constituted by the fact that the member 156 constituting the discharge port 153 and channel 155 is set on the element substratum 152. A flexible printed wiring board 160 provided with a compact pad 159 for receiving an electrical signal from the body of a printer is connected to the discharge unit 150 and electrical signals serving as various driving signals are supplied to the discharge unit 150 from the control portion of the printer body through the flexible printed wiring board 160.

Figure 8:
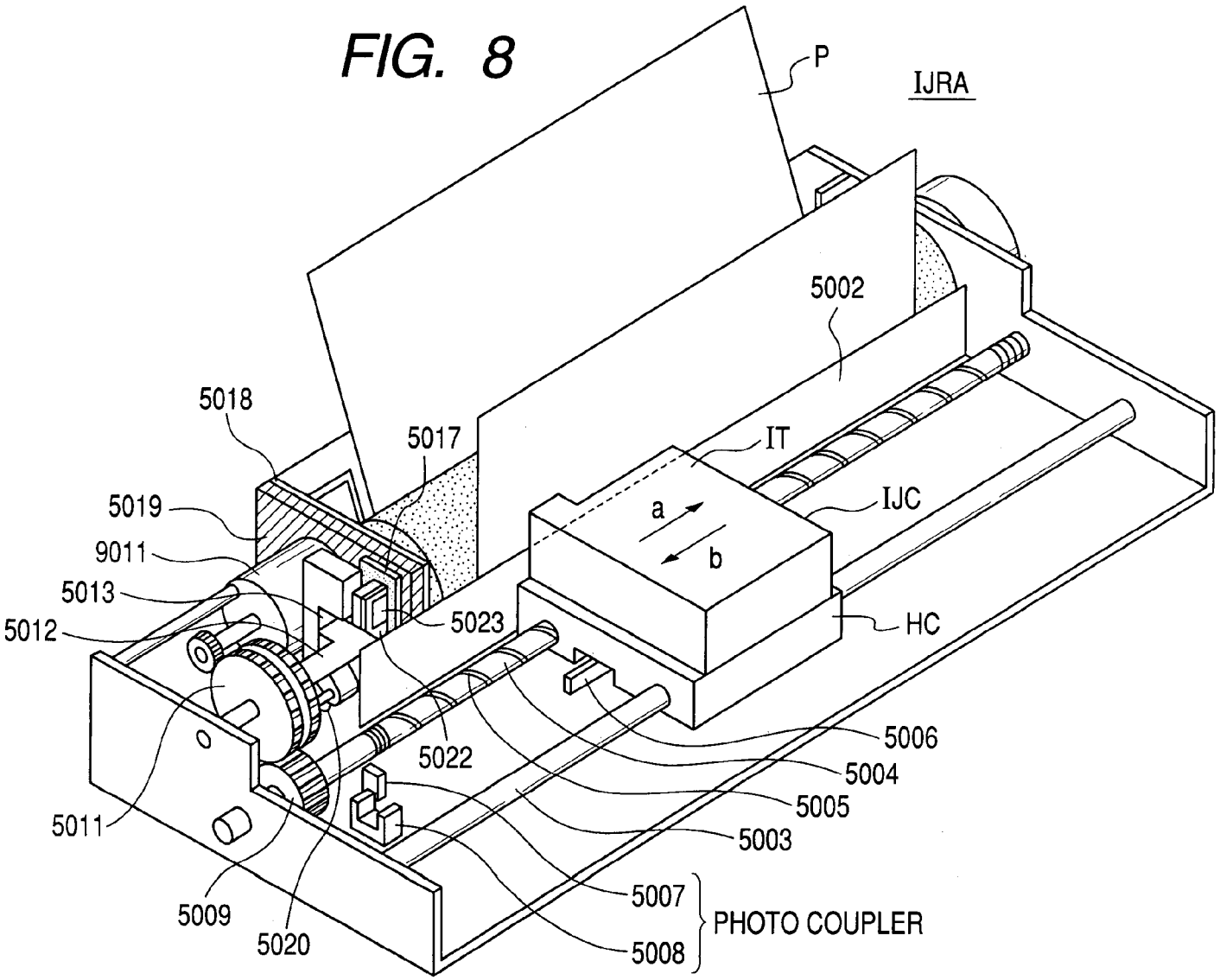
FIG. 8 is a perspective view showing a schematic configuration of an ink-jet recorder which is an embodiment of a liquid discharge apparatus to which a liquid discharge head of the present invention is applied.

FIG. 8 is a perspective view showing a schematic configuration of an ink-jet recorder IJRA which is an embodiment of a liquid discharge apparatus to which a liquid discharge head of the present invention is applied.

A carriage HC having a pin (not illustrated) engaged with a spiral groove 5004 of a rotating lead screw 5005 through driving force transfer gears 5011 and 5009 by interlocking with normal/reverse rotation of a driving motor 9011 is reciprocated in directions of arrows a and b along a guide shaft 5003 in accordance with normal/reverse rotation of the lead screw 5005. A recording head IJC and an ink tank IT for supplying ink to the recording head IJC are mounted on the carriage HC.

A sheet holding plate 5002 presses a recording sheet P against a platen (not illustrated) serving as recording-medium transport means over the moving range of the carriage HC. Photocouplers 5007 and 5008 serving as home position detection means respectively confirm the presence of he lever 5006 of the carriage HC in this region and output a signal for changing rotational directions of the driving motor 9011. A cap member 5022 for capping the ink-discharge-port forming face of the recording head IJC is supported by a support member 5013. When starting attraction for attraction recovery, a lever 5012 moves in accordance with the movement of a cam 5020 engaging with the carriage HC and the driving force from the driving motor 9011 is changed by widely-known transfer means such as clutch changeover and the cap member 5022 is movement-controlled so as to contact with the ink-discharge-port forming face of the recording head IJC. Under this state, by attracting the cap member 5022 by attraction means (not illustrated), attraction recovery of the recording head JCI is performed through an opening 5023 in the cap.

A movement member 5019 capable of moving a cleaning blade 5017 in the direction in which the blade 5017 moves toward or away from the recording head IJC is supported by a body support plate 5018 and the cleaning blade 5017 is set to the movement member 5019. It is needless to say that not only the illustrated conformation but also other widely-known conformation can be applied to the cleaning blade 5017.

The ink-jet recorder IJRA is constituted so as to perform a desired operation out of the capping operation, cleaning operation, attraction recovery operation at each corresponding position by making the lead screw 5005 perform a predetermined rotating operation when the carriage HC moves to the home-position-side region. Timings for performing these operations are widely known and the widely-known timings can be applied to this embodiment. Each of the above configurations is compositionally a superior configuration and shows a configuration to which a liquid discharge head of the present invention is preferably applied.

Moreover, this apparatus IJRA has an electric circuit for supplying a power supply voltage, image signal and driving control signal to the discharge unit 150 (refer to FIG. 6).

The present invention is not restricted to the above embodiments. It is clear that each configuration requirement of the present invention can be replaced with any substitute or equivalence that can solve the above mentioned problems.

This application claims priority from Japanese Patent Application No. 2004-129774 filed Apr. 26, 2004, which is hereby incorporated by reference herein.

What is claimed is:

1. A liquid discharge head in which an electrothermal transducer and a switch circuit are electrically connected in series between a first power supply and a second power supply to perform discharge control of liquid in accordance with the control of energy injection to the electrothermal transducer by the switch circuit, comprising:

a comparator circuit for outputting a signal based on comparing, with a reference voltage, a voltage of a connection point between the electrothermal transducer and the switch circuit; and an OR circuit for controlling the switch circuit, responsive to the signal outputted from the comparator.

2. The liquid discharge head according to claim 1, wherein the switch circuit includes any one of an NPN bipolar transistor, MOS transistor, offset MOS transistor, LDMOS transistor and VDMOS transistor.

3. The liquid discharge head according to claim 1, wherein liquid non-discharge detection is performed in accordance with a detection result from the detection circuit.

4. A liquid discharge apparatus comprising the liquid discharge head of claim 1.

* * * * *

UNITED STATES PATENT AND TRADEMARK OFFICE

CERTIFICATE OF CORRECTION

PATENT NO. : 7,350,891 B2
APPLICATION NO. : 11/113013
DATED : April 1, 2008
INVENTOR(S) : Masanobu Oomura et al.

It is certified that error appears in the above-identified patent and that said Letters Patent is hereby corrected as shown below:

COLUMN 3:
Line 16, “in” should read -- an --.

COLUMN 4:
Line 35, “necessity” should read -- necessary --.
Line 59, “necessity” should read -- necessary --.

COLUMN 6:
Line 5, “extremely” should read -- unnecessarily --.

COLUMN 7:
Line 32, “for” should read -- as a --.
Line 54, “extremely” should read -- unnecessarily --.

COLUMN 10:
Line 40, “τand” should read -- τ and --.

COLUMN 11:
Line 48, “above-describe” should read -- above-described --.

COLUMN 12:
Line 22, “sand” should read -- τ and --.

COLUMN 13:
Line 19, “above described” should read -- above-described --.
Line 60, “he” should read -- the --.

UNITED STATES PATENT AND TRADEMARK OFFICE

CERTIFICATE OF CORRECTION

PATENT NO. : 7,350,891 B2
APPLICATION NO. : 11/113013
DATED : April 1, 2008
INVENTOR(S) : Masanobu Oomura et al.

It is certified that error appears in the above-identified patent and that said Letters Patent is hereby corrected as shown below:

COLUMN 14:

Line 35, "above mentioned" should read -- above-mentioned --.

Signed and Sealed this

Third Day of March, 2009

JOHN DOLL
*Acting Director of the United States Patent and Trademark Office*